US012280467B1

(12) United States Patent
Watson

(10) Patent No.: US 12,280,467 B1
(45) Date of Patent: Apr. 22, 2025

(54) MULTI-FIBER FIBER OPTIC FERRULE POLISHING SYSTEMS AND METHODS

(71) Applicant: Ortronics, Inc., New London, CT (US)

(72) Inventor: Matthew Cameron Watson, Morganton, NC (US)

(73) Assignee: Legrand DPC, LLC, West Hartford, CT (US)

( * ) Notice: Subject to any disclaimer, the term of this patent is extended or adjusted under 35 U.S.C. 154(b) by 509 days.

(21) Appl. No.: 17/104,315

(22) Filed: Nov. 25, 2020

Related U.S. Application Data

(60) Provisional application No. 62/961,045, filed on Jan. 14, 2020.

(51) Int. Cl.
*B24C 1/08* (2006.01)
*B24B 19/22* (2006.01)

(52) U.S. Cl.
CPC ..... *B24C 1/08* (2013.01); *B24B 19/226* (2013.01)

(58) Field of Classification Search
CPC ..... B24C 1/08; G02B 6/3863; B24B 19/226; B24B 41/06
See application file for complete search history.

(56) References Cited

U.S. PATENT DOCUMENTS 4,905,415 A * 3/1990 Moulin ..... B24B 19/226 451/279
5,727,989 A * 3/1998 Ohno ..... B24B 11/00 451/60
5,743,785 A * 4/1998 Lundberg ..... B24B 41/06 451/271
6,106,368 A * 8/2000 Childers ..... B24D 13/10 451/28
6,443,827 B1 * 9/2002 Ryoke ..... B24B 37/24 451/539
6,632,026 B2 * 10/2003 Baba ..... B24B 37/042 385/85

(Continued)

OTHER PUBLICATIONS

Fiber Optic Center ("FOC") ("Polishing Instructions for Domaille APM-HDC 5300/4000") (Year: 2023).*

(Continued)

*Primary Examiner* — Duy Vu N Deo
*Assistant Examiner* — Christopher Remavege
(74) *Attorney, Agent, or Firm* — McCarter & English, LLP

(57) ABSTRACT

An example method of polishing multi-fiber fiber optic ferrules with a polishing device is provided. The polishing device includes a polishing component with a polishing surface and a surface for securing multi-fiber fiber optic ferrules such that endfaces of the multi-fiber fiber optic ferrules are oriented to face and be positioned against the polishing surface. The method includes orienting an application device with a spray nozzle about 8 inches to about 12 inches away from the polishing surface, and orienting the spray nozzle of the application device at a downward angle of about 200 to about 300 relative to horizontal and the polishing surface. The method includes applying a fine mist of fluid from the spray nozzle toward the polishing surface to completely coat the polishing surface with the fluid. The method includes positioning the endfaces of the multi-fiber fiber optic ferrules against the polishing surface and polishing the endfaces.

20 Claims, 6 Drawing Sheets

(56) References Cited

U.S. PATENT DOCUMENTS 6,764,223 B2 * 7/2004 Rosson ..... G02B 6/3881 385/78
7,695,201 B2 * 4/2010 Douglas ..... G02B 6/3863 451/28
8,002,609 B2 * 8/2011 Lu ..... G02B 6/25 451/41
9,296,081 B2 * 3/2016 Wang ..... G02B 6/3863
2002/0115386 A1 * 8/2002 Lijima ..... B24B 19/226 451/41
2002/0142705 A1 * 10/2002 Sugiura ..... B24D 3/28 451/41
2003/0054741 A1 * 3/2003 Ling ..... B24B 19/226 451/177
2003/0171078 A1 * 9/2003 Ryoke ..... G02B 6/25 451/41
2004/0007690 A1 * 1/2004 Snider ..... C09K 3/1463 252/79.1
2005/0260932 A1 * 11/2005 Gazit ..... B24B 19/226 451/42
2006/0072879 A1 * 4/2006 Yang ..... B24B 19/226 385/76
2009/0298391 A1 * 12/2009 Yamada ..... B24B 19/226 451/41
2011/0312249 A1 * 12/2011 Bylander ..... B24B 19/226 451/28
2018/0236627 A1 * 8/2018 Xin ..... B24B 19/226
2018/0341068 A1 * 11/2018 Igawa ..... B24B 19/226
2021/0122003 A1 * 4/2021 Werner ..... B24B 19/226

OTHER PUBLICATIONS

Wayback Machine Printout of FOC.com, dated to Mar. 5, 2019. (Year: 2023).*

* cited by examiner

MULTI-FIBER FIBER OPTIC FERRULE POLISHING SYSTEMS AND METHODS

CROSS-REFERENCE TO RELATED APPLICATIONS

This application claims the benefit of, commonly assigned U.S. Provisional Patent Application No. 62/961,045, which was filed on Jan. 14, 2020. The entire content of the foregoing provisional application is incorporated herein by reference.

BACKGROUND

In the fiber optic industry, increasing data speeds have generally resulted in increased pressure on loss budgets, particularly when dealing with fiber optic connectivity. Traditional fiber link topology can be served by Multi-Fiber Push On (MPO)-to-LC cassettes and breakout harnesses, and can be combined with MPO-to-MPO trunk cables, and/or LC-to-LC patch cords. In such traditional fiber link topology, achieving consistently low insertion loss on the multi-fiber MPO connections has generally proven difficult, particularly in single-mode connections. Single-mode MPO connectors are typically angle-polished to meet the stringent return loss requirements of the optical launch devices used in such telecommunications links.

Due to the inherent imprecision of the traditional polishing process, maintaining consistent physical contact across all fibers in a single-mode MPO connection (which in common practice can be up to 24 fibers) may be achieved if the coplanarity, e.g., the deviation of the worst fiber ends from an ideal mating plane, is exceptionally low. In some instances, coplanarity can be calculated indirectly by measuring the differential fiber height of all fibers by means of optical interferometry. Industry standard measures generally necessitate differential fiber height to be no more than 500 nm (e.g., the tallest fiber can stand no more than ½ a micron higher than the lowest fiber, regardless of fiber position). However, even this level of precision is generally good enough to guarantee connection insertion loss on the order of about 0.75 dB per mated pair of fibers.

Traditional fiber connector polishing can involve semi-automated equipment that presses the fiber ferrule endfaces against an abrasive polishing surface over an orbital motion pattern. This can be performed in multiple stages that can vary in terms of duration, downward pressure, and abrasive type. Table 1 below provides an example of steps performed during traditional fiber connector polishing:

TABLE 1

Traditional Fiber Connector Polishing Steps

| Step | Film | Film Mfg. | Polishing Surface Type | Seconds | Speed (RPM) | Pressure (lbs) |
|---|---|---|---|---|---|---|
| 1 | SC30F50-EP100 | Mipox | 30 um Silicon Carbide, PSA | 20 | 150 | 4.5 |
| 2 | 463X | 3M | 3 um Silicon Carbide, non-PSA | 60 | 150 | 4.5 |
| 3 | 298X | 3M | 1 um Aluminum Oxide Flocked, PSA | 120 | 150 | 10 |
| 4 | 498X | 3M | 0.5 um Cerium Oxide Flocked, PSA | 120 | 150 | 10 |

with PSA representing pressure sensitive adhesive. During the polishing process, a liquid (e.g., distilled water) is added to the polishing surface. The water both lubricates the polishing surface and carries away particulate matter ground off of the ferrule and fiber endfaces. If not removed, such ground particulates may otherwise induce deep scratches in the fiber, which could undermine optical performance of the resultant connector. Traditional fiber polishing processes generally rely on adding a large amount of water to the polishing surface with the intention of making the ground particulates more mobile, thereby clearing the ground particulates away from the polishing area. As such, traditional fiber polishing processes typically implement a differential fiber height of no more than 500 nm (resulting in a connection insertion loss on the order of about 0.75 dB per mated pair of fibers) and a large amount of water on the polishing surface.

SUMMARY

Exemplary embodiments of the present disclosure provide exemplary systems and methods of polishing multi-fiber fiber optic ferrules. The exemplary systems achieve a more consistent insertion loss performance of the fibers as compared to traditional fiber polishing systems and methods. The exemplary systems use less water during the polishing step as compared to traditional fiber polishing systems and methods and ensure the uniformity of the coating of the polishing surface, resulting in improved coplanarity which, in turn, results in an improvement in terms of reduced insertion loss.

In accordance with embodiments of the present disclosure, an exemplary method of polishing multi-fiber fiber optic ferrules with a polishing device is provided. The polishing device can include a polishing component with a polishing surface and a surface for securing the multi-fiber fiber optic ferrules such that endfaces of the multi-fiber fiber optic ferrules are oriented to face and be positioned against the polishing surface. The method includes orienting an application device with a spray nozzle about 8 inches to about 12 inches away from the polishing surface of the polishing component. The method includes orienting the spray nozzle of the application device at a downward angle of about 200 to about 300 relative to horizontal and the polishing surface. The method includes applying a fine mist of fluid from the spray nozzle toward the polishing surface to completely coat the polishing surface with the fluid. The method includes positioning the endfaces of the multi-fiber fiber optic ferrules against the polishing surface and polishing the endfaces of the multi-fiber fiber optic ferrules.

The method includes applying the fine mist of the fluid from the spray nozzle toward the polishing surface in a conical configuration. In some embodiments, the conical configuration of the fine mist includes an angle of about 150 to about 200 between topmost and bottommost spray lines extending from the spray nozzle. In some embodiments, the angle of the conical configuration of the fine mist can be about 160 to about 19°. In some embodiments, the angle of the conical configuration of the fine mist can be about 170 and about 18°. In some embodiments, the angle of the conical configuration of the fine mist can be about 17.5°.

In some embodiments, the method can include dispensing about 2 mL to about 6 mL of the fine mist of the fluid onto the polishing surface with the spray nozzle to completely coat the polishing surface with the fluid. In some embodiments, the fluid can be water. The method includes forming a fine slurry with particulate matter from polishing of the endfaces of the multi-fiber fiber optic ferrules and the fluid on the polishing surface. The fine slurry can provide a substantially uniform suspension resulting in coplanarity along the polishing surface.

In some embodiments, the polishing surface of the polishing component can be about 4 inches to about 6 inches in diameter. In some embodiments, the downward angle of the spray nozzle relative to the polishing surface can be about 220 to about 28°. In some embodiments, the downward angle of the spray nozzle relative to the polishing surface can be about 240 to about 26°. In some embodiments, the downward angle of the spray nozzle relative to the polishing surface can be about 25°. In some embodiments, a distance between the spray nozzle and the polishing surface can be about 9 inches to about 11 inches. In some embodiments, a distance between the spray nozzle and the polishing surface can be about 10 inches.

In accordance with embodiments of the present disclosure, an exemplary multi-fiber fiber optic ferrule polishing system is provided. The system includes a polishing device including a surface for securing multi-fiber fiber optic ferrules such that endfaces of the multi-fiber fiber optic ferrules are oriented to face and be positioned against a polishing surface of a polishing component. The polishing device includes a mounting platform. The system includes the polishing component positioned on the mounting platform of the polishing device. The system includes an application device including a spray nozzle for dispensing of fluid in a fine mist onto the polishing surface of the polishing component to completely coat the polishing surface with the fluid. An orientation of the application device is adjustable relative to the polishing device such that the spray nozzle of the application device is positionable about 8 inches to about 12 inches away from the polishing surface of the polishing component. An orientation of the application device is adjustable relative to the polishing device such that the spray nozzle of the application device is positionable at a downward angle of about 200 to about 300 relative to horizontal and the polishing surface.

The application device can be configured to apply the fine mist of the fluid from the spray nozzle toward the polishing surface in a conical configuration. In some embodiments, the conical configuration of the fine mist includes an angle of about 150 to about 200 between topmost and bottommost spray lines extending from the spray nozzle. The application device can be configured to dispense about 2 mL to about 6 mL of the fine mist of the fluid onto the polishing surface with the spray nozzle to completely coat the polishing surface with the fluid. Polishing the endfaces of the multi-fiber fiber optic ferrules with the polishing surface completely coated with the fluid can form a fine slurry with particulate matter from polishing of the endfaces of the multi-fiber fiber optic ferrules and the fluid on the polishing surface. The fine slurry can provide a substantially uniform suspension resulting in coplanarity along the polishing surface.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the multi-fiber fiber optic ferrule polishing systems and methods, reference is made to the accompanying figures, wherein.

DETAILED DESCRIPTION

Exemplary embodiments of the present disclosure provide a system and method of fiber optic polishing. In particular, the exemplary systems and methods can be used for polishing multi-fiber fiber optic ferrules. The exemplary systems achieve a more consistent insertion loss performance of the fibers as compared to traditional fiber polishing systems and methods. Experimentation has shown that if coplanarity (e.g., the deviation of the worst fiber ends from an ideal mating plane) can be held to under about 200 nm, vastly superior and more consistent insertion loss performance can be achieved.

In some embodiments, holding the coplanarity under about 200 nm can result in insertion loss performance on the order of about 0.27 dB per mated pair of fibers, a nearly threefold improvement relative to the insertion loss performance from fibers polished using traditional methods. Experimentation has also shown that adding less water (as compared to traditional polishing methods), while minding the uniformity of the coating of the polishing surface, achieves improved coplanarity which, in turn, translates to superior insertion loss. The exemplary systems provide fine control of the quantity and distribution of water on the polishing surface prior to each polishing step to achieve the improved coplanarity and superior insertion loss.

Figure 1:
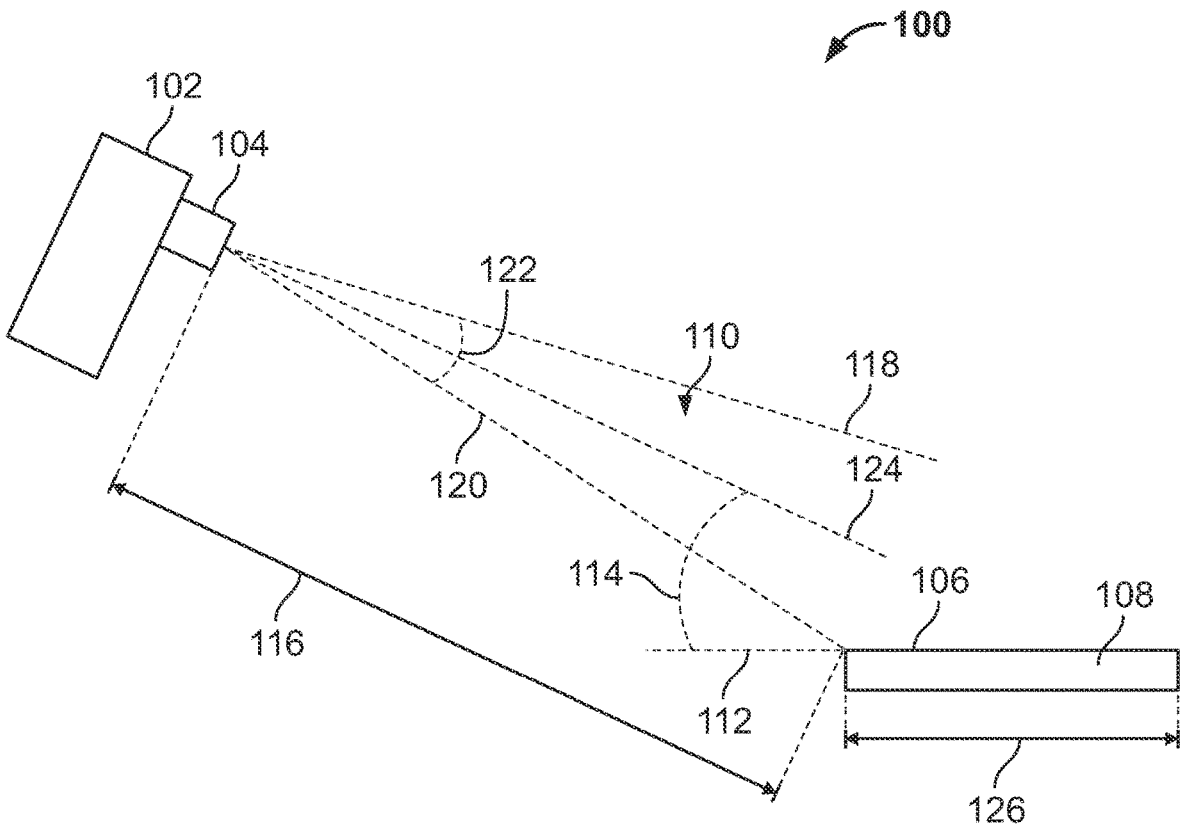
FIG. 1 is a diagrammatic side view of a multi-fiber fiber optic ferrule polishing system in an exemplary embodiment.

FIG. 1 is a diagrammatic side view of an exemplary multi-fiber fiber optic ferrule polishing system 100 (hereinafter "system 100") of the present disclosure. The system 100 includes an application device 102 including a spray nozzle 104. In some embodiments, the application device 102 can be manually controlled. In some embodiments, the application device 102 can be electronically controlled. The application device 102 can be used to spray or direct a fine mist 110 of fluid (e.g., water) with the spray nozzle 104 onto a polishing surface 106 of a polishing component 108 (e.g., a polishing disc). The polishing component 108 can be placed or secured to a mounting platform of a polishing device (not shown). The polishing component 108 can be maintained substantially parallel to horizontal 112. In some embodiments, the horizontal area (e.g., top surface) of the polishing surface 106 can be in a range of about 4 inches and about 6 inches in diameter 126.

In order to provide the desired amount of water to the polishing surface 106, the orientation of the spray nozzle 104 relative to the polishing surface 106 described herein should be used. The spray nozzle 104 of the application device 102 is oriented at a shallow downward angle 114 relative to horizontal 112 and the top horizontal surface of the polishing surface 106. The angle 114 can be measured between horizontal 114 and the central axis 124 associated with the spray nozzle 104. In some embodiments, the angle 114 can be, e.g., about 200 to about 30°, about 220 to about 28°, about 240 to about 26°, about 25°, or the like. The distance 116 between the spray nozzle 104 and the polishing surface 106 can be, e.g., about 8 inches to about 12 inches, about 9 inches to about 11 inches, about 10 inches, or the like.

The mist 110 generated by the spray nozzle 104 can define a substantially conical configuration, represented by the topmost spray line 118 and the bottommost spray line 120. The angle 122 between the topmost and bottommost spray lines 118, 120 can be, e.g., about 150 to about 20°, about 160 to about 19°, about 170 to about 18°, about 17.5°, about 17°, about 16°, about 15°, or the like. The angle 122 can be selected such that complete coverage of the polishing surface 106 is achieved without creating water droplets on the polishing surface 106. The spray nozzle 104 can dispense about 2 mL to about 6 mL of water toward the polishing surface 106. Generally, the amount of water on the polishing surface 106 is less than the amount dispensed toward the polishing surface 106 (e.g., less than about 2 mL to about 6 mL).

Much of the water dispensed by the spray nozzle 104 does not fall upon the polishing surface 106, but instead is lost due to passage around or beyond the polishing surface 106. The objective is to coat the polishing surface 106 with water completely, while maintaining the water coating as thin as possible. Particularly, the amount of water on the polishing surface 106 can be selected to ensure that the entire polishing surface 106 is wetted with a thin layer without dry spots and without water droplets. The quantity and/or the dispensing angle 114 of the water discussed above are essential for achieving the thin water coating on the polishing surface 106. If sprayed at too high an angle 114, the water may bead on the polishing surface 106, leaving some spots dry of the polishing surface 106 dry.

Such dry spots can enable particulate matter to concentrate on the polishing surface 106, and may result in damaging surface scratches. The dry spots may create variable coefficients of friction over the polishing surface 106, reducing polish uniformity. The correct amount of water applied at the correct orientation can turn the water and mixed particulates on the polishing surface 106 into a fine slurry. The fine slurry can form a uniform suspension that can more uniformly wear down all parts of the ferrule endface, and thereby uniformly wear away all fiber endfaces held therein. Too much water may induce poorer coplanarity across the ferrule endface, because the amount of particulates in the water may be too small to form a fine slurry suspension. If more water is used than the noted range, the particulates can be carried away from the polishing surface 106 during the polishing process, creating a differential polishing condition as the particulates migrate. If the amount of water used is within the noted range, the particulates distribute substantially evenly within the water and do not migrate to and over the edge of the polishing surface 106.

While it may seem counterintuitive that leaving the particulate matter uniformly distributed in a suspension would be superior to pulling or removing the particulate matter away from the polishing surface 106, the issue relates to preventing differential in fiber height. Specifically, the goal of the system 100 is to prevent some fibers from being ground away at different rates than other fibers. Using traditional systems, the outer fibers in the MPO array are generally ground down faster as these fibers are typically exposed to more particulate matter for a longer period of time as compared to material that is ground away from the center of the ferrule. As such, by using more water in traditional fiber polishing systems, the outer fiber positions are more aggressively polished than the inner fiber positions.

In general, insertion loss performance is consistently worse for the outside fiber positions in comparison to inner positions for MPO connector products in the industry. Such results are because the outer positions, standing shorter, are worn down more aggressively and rarely make good physical contact with their mating counterparts. The outer fiber positions almost invariably have a relatively large, negative differential fiber height in comparison to the inner fiber positions. In general, it is the worst-performing fiber position that determines the suitability of a given MPO connector to perform the intended data transmission service. By applying water to the polishing surface 106 in the above-described manner, the particulate material slurry generated by the system 100 ensures improved ensures coplanarity of the polishing surface 106, resulting in a more uniform differential in fiber height. By reducing the differential polish between the inside and outside fiber positions on the polishing surface 106, the system 100 enables levels of overall performance that were previously unachievable by traditional systems in mass production at acceptable levels of process yield.

Figure 2:
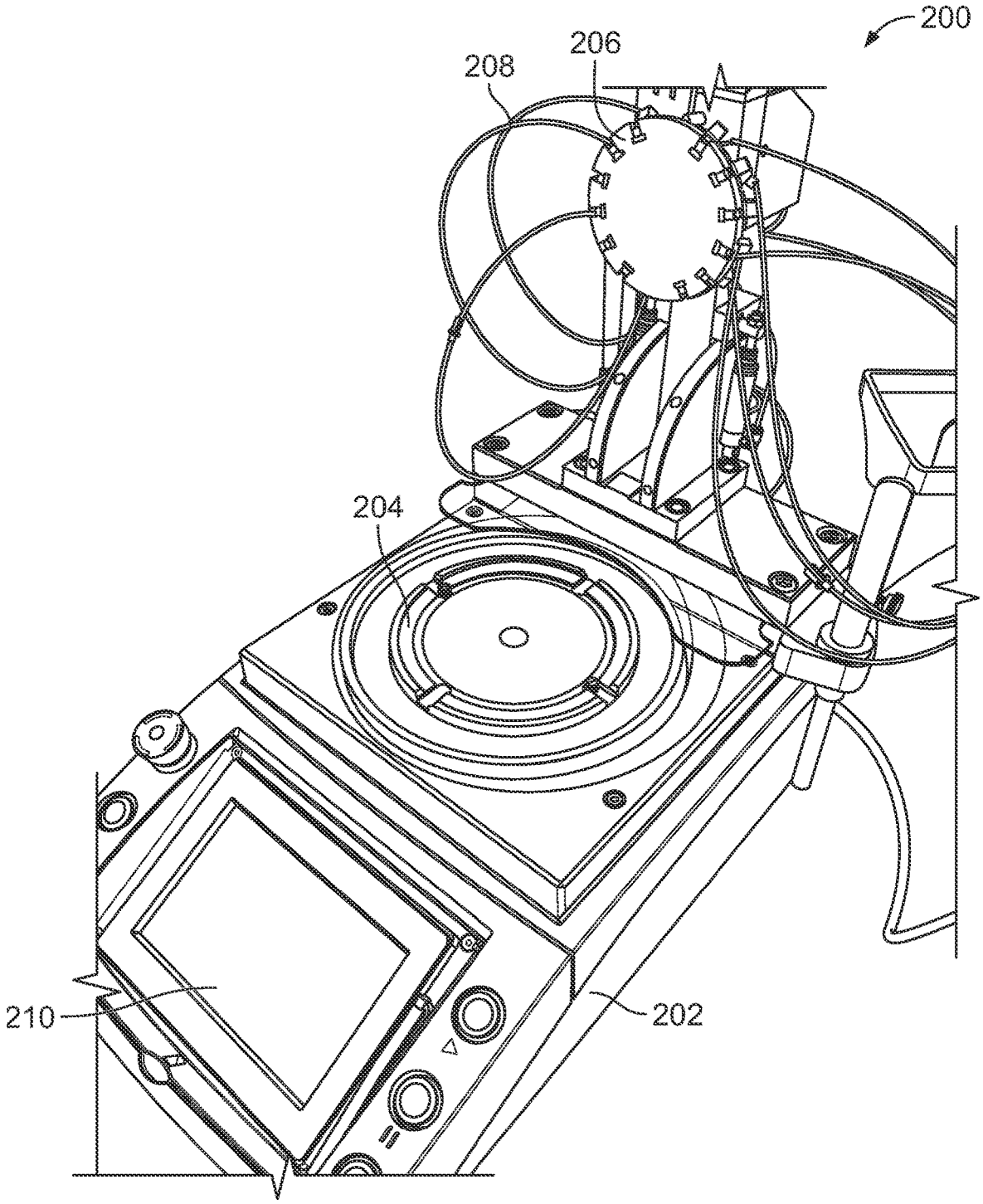
FIG. 2 is a top perspective view of a multi-fiber fiber optic ferrule polishing system in an exemplary embodiment prior to insertion of a polishing component.

FIG. 2 is a top perspective view of an exemplary multi-fiber fiber optic ferrule polishing system 200 (hereinafter "system 200") of the present disclosure. The system 200 can be substantially similar in structure and function to the system 100. The system 200 includes a polishing device 202 including a mounting platform 204 configured to receive a polishing component (e.g., polishing component 108). The system 200 includes a top surface 206 pivotally coupled to the base of the polishing device 202. The top surface 206 is configured to receive one or more multi-fiber fiber optic ferrules 208 such that the endfaces of the multi-fiber fiber optic ferrules 208 can be positioned against the polishing surface of the polishing component. In some embodiments, each ferrule 208 can include eight (8) or more optical fibers. The polishing device 202 can include a user interface 210 for controlling operation of, e.g., the polishing device 202, the application device for applying mist to the polishing component, combinations there, or the like.

Figure 3:
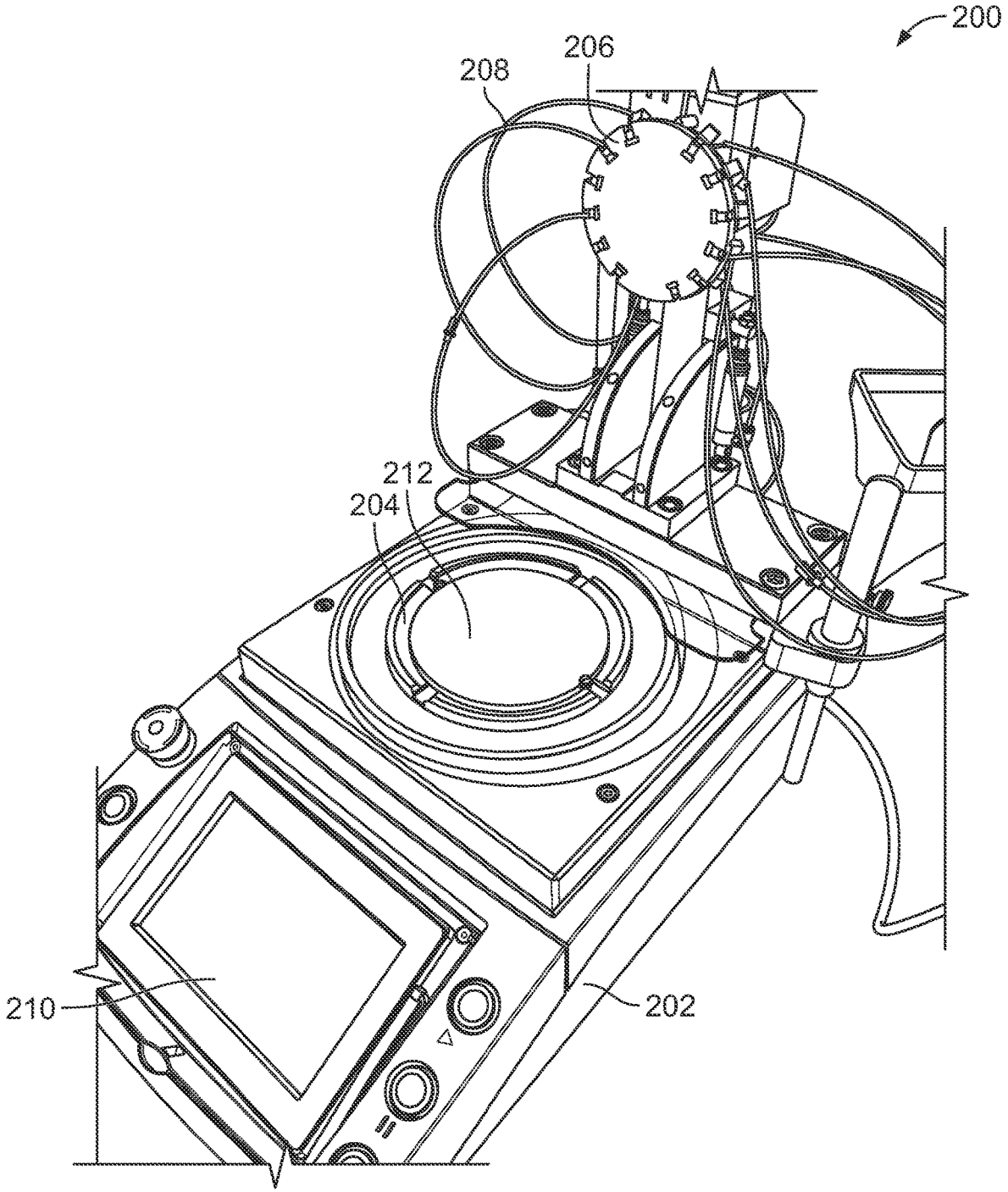
FIG. 3 is a top perspective view of a multi-fiber fiber optic ferrule polishing system in an exemplary embodiment after insertion of a polishing component.
Figure 4:
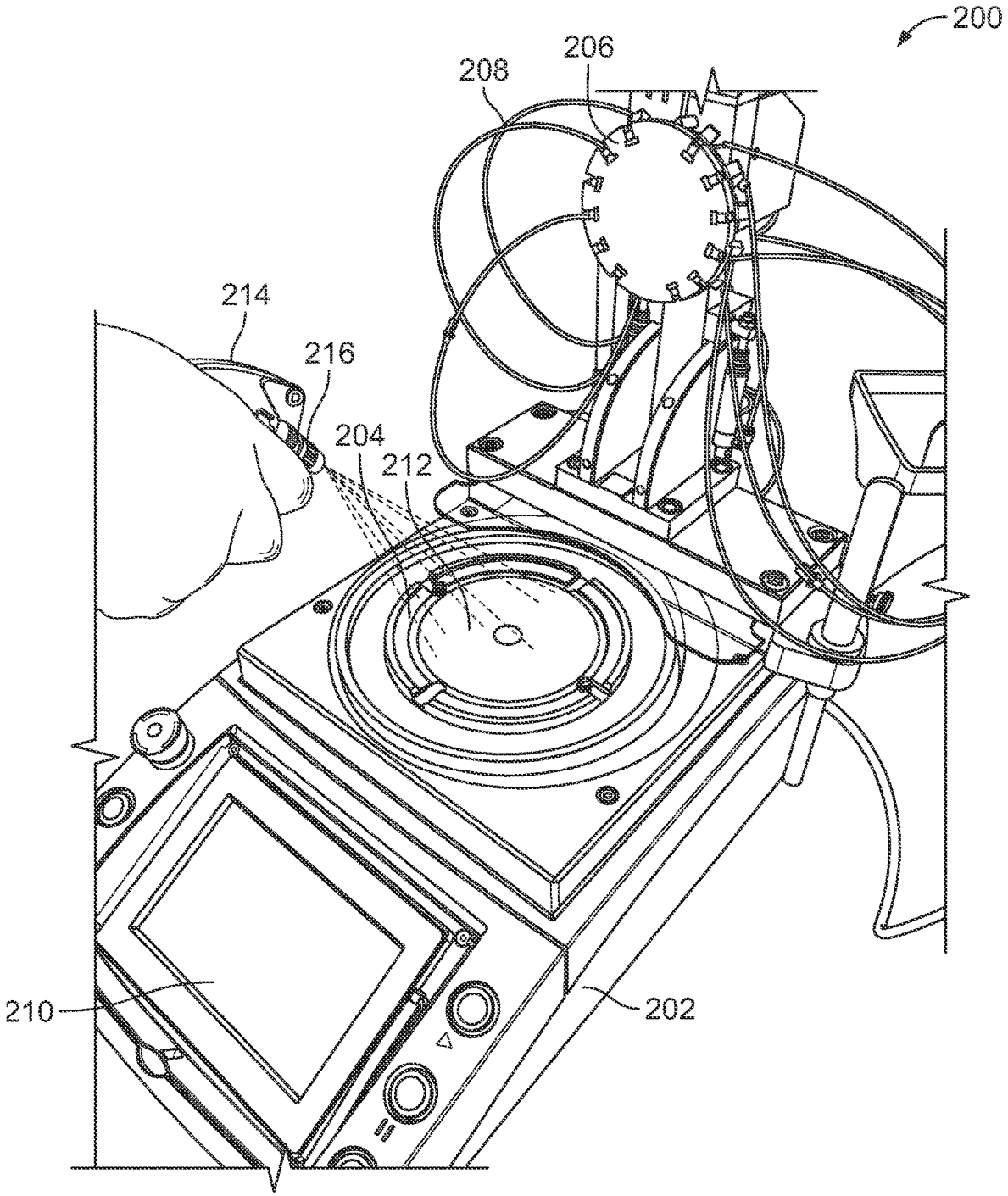
FIG. 4 is a top perspective view of a multi-fiber fiber optic ferrule polishing system in an exemplary embodiment during application of water to a polishing component.
Figure 5:
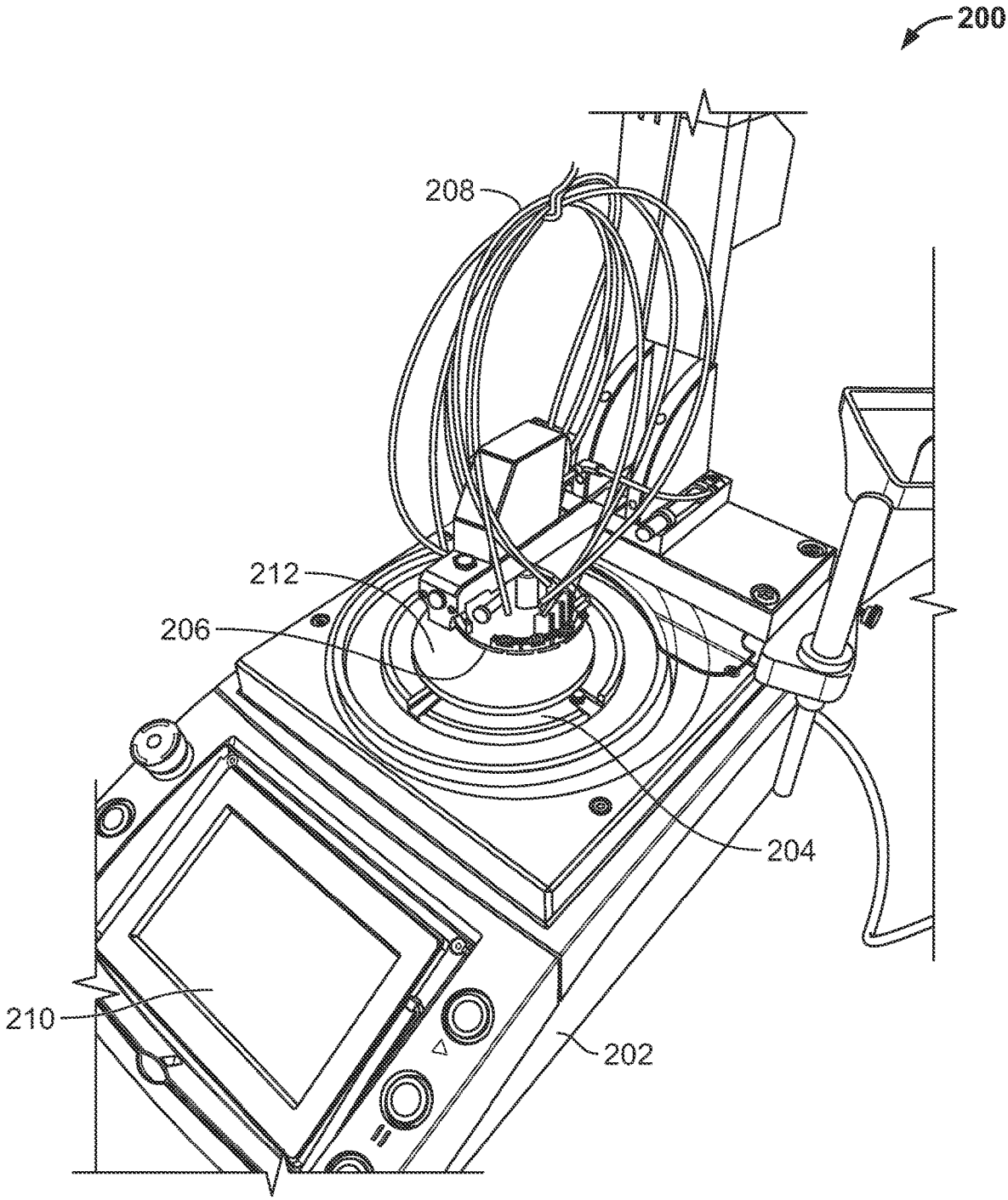
FIG. 5 is a top perspective view of a multi-fiber fiber optic ferrule polishing system in an exemplary embodiment during a polishing step.

FIG. 3 is a top perspective view of the system 200, including a polishing component 212 mounted or positioned on the mounting platform 204. FIG. 4 is a top perspective view of the system 200, including an application device 214 with a spray nozzle 216 during dispensing of a fine water mist to the polishing surface of the polishing component 212. Although shown as applied manually, in some embodiments, the dispensing of the fine water mist can be performed in an automated manner. FIG. 5 is a top perspective view of the system 200 during the polishing step, including the top surface 206 rotated downwardly such that the endfaces of the multi-fiber fiber optic ferrules 208 are disposed against the polishing surface of the polishing component 212.

Figure 6:
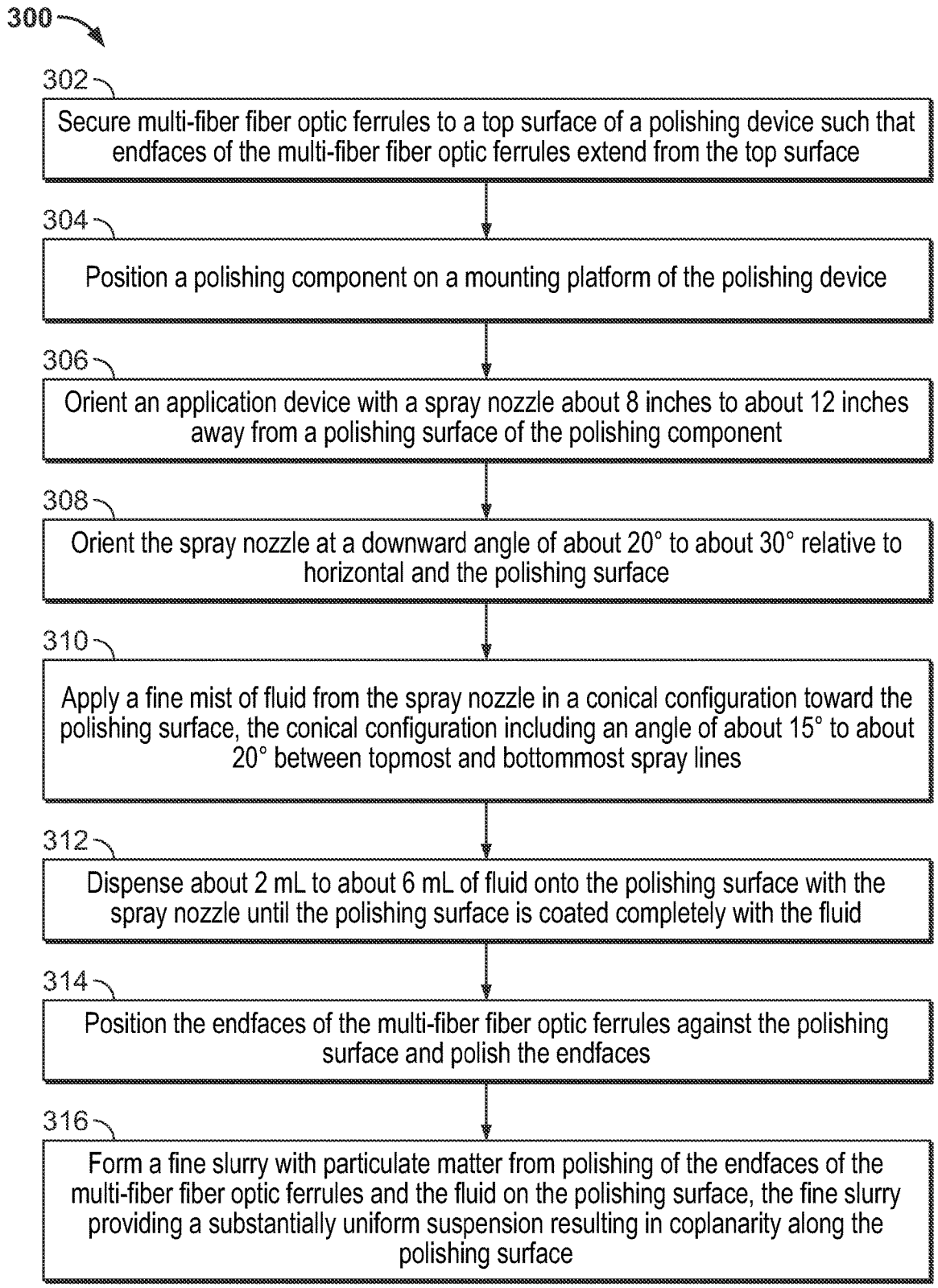
FIG. 6 is a flowchart of a process of multi-fiber fiber optic ferrule polishing in an exemplary embodiment.

FIG. 6 is a flowchart illustrating an exemplary process 300 of polishing multi-fiber fiber optic ferrules. At step 302, the multi-fiber fiber optic ferrules can be secured to a top surface of a polishing device such that endfaces of the multi-fiber fiber optic ferrules extend from the top surface. At step 304, a polishing component can be positioned on a mounting platform of the polishing device. At step 306, an application device with a spray nozzle can be oriented about 8 inches to about 12 inches away from the polishing surface of the polishing component (as measured between the polishing surface and the spray nozzle). At step 308, the spray nozzle can be oriented at a downward angle of about 200 to about 300 relative to horizontal and the polishing surface.

At step 310, a fine mist of fluid (e.g., water) can be applied from the spray nozzle in a conical configuration toward the polishing surface. The conical configuration can include an angle of about 150 to about 200 between topmost and bottommost spray lines extending from the spray nozzle. At step 312, about 2 mL to about 6 mL of fluid can be dispensed onto the polishing surface in a fine mist with the spray nozzle until the polishing surface is coated completely with the fluid. At step 314, the endfaces of the multi-fiber fiber optic ferrules can be positioned against the polishing surface and the endfaces can be polished. At step 316, a fine slurry can be formed on the top of the polishing surface due to mixture of the particulate matter from polishing of the endfaces of the multi-fiber fiber optic ferrules and the fluid coating the polishing surface. The fine slurry can provide a substantially uniform suspension resulting in coplanarity along the polishing surface.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A method of polishing multi-fiber fiber optic ferrules with a polishing device, the polishing device including a polishing component with a polishing surface and a surface for securing multi-fiber fiber optic ferrules such that endfaces of the multi-fiber fiber optic ferrules are oriented to face and be positioned against the polishing surface, the method comprising:

orienting an application device with a spray nozzle about 8 inches to about 12 inches away from the polishing surface of the polishing component;

orienting the spray nozzle of the application device at a downward angle of about 20° to about 30° relative to horizontal and the polishing surface;

applying a fine mist of fluid from the spray nozzle toward the polishing surface to completely coat the polishing surface with the fluid, wherein the application device and the polishing surface are maintained stationary to each other during application of the fine mist; and positioning the endfaces of the multi-fiber fiber optic ferrules against the polishing surface and polishing the endfaces.

2. The method of claim 1, comprising applying the fine mist of the fluid from the spray nozzle toward the polishing surface in a conical configuration.

3. The method of claim 2, wherein the conical configuration of the fine mist includes an angle of about 15° to about 20° between topmost and bottommost spray lines extending from the spray nozzle.

4. The method of claim 3, wherein the angle of the conical configuration of the fine mist is about 16° to about 19°.

5. The method of claim 3, wherein the angle of the conical configuration of the fine mist is about 17° and about 18°.

6. The method of claim 3, wherein the angle of the conical configuration of the fine mist is about 17.5°.

7. The method of claim 1, comprising dispensing about 2 mL to about 6 mL of the fine mist of the fluid onto the polishing surface with the spray nozzle to completely coat the polishing surface with the fluid.

8. The method of claim 1, wherein the fluid is water.

9. The method of claim 1, comprising forming a fine slurry consisting of particulate matter from polishing of the endfaces of the multi-fiber fiber optic ferrules and the fluid on the polishing surface.

10. The method of claim 9, wherein the fine slurry provides a substantially uniform suspension resulting in coplanarity along the polishing surface.

11. The method of claim 1, wherein the polishing surface of the polishing component is about 4 inches to about 6 inches in diameter.

12. The method of claim 1, wherein the downward angle of the spray nozzle relative to the polishing surface is about 22° to about 28°.

13. The method of claim 1, wherein the downward angle of the spray nozzle relative to the polishing surface is about 24° to about 26°.

14. The method of claim 1, wherein the downward angle of the spray nozzle relative to the polishing surface is about 25°.

15. The method of claim 1, wherein a distance between the spray nozzle and the polishing surface is about 9 inches to about 11 inches.

16. The method of claim 1, wherein a distance between the spray nozzle and the polishing surface is about 10 inches.

17. A multi-fiber fiber optic ferrule polishing system, comprising:

a polishing device including a surface for securing multi-fiber fiber optic ferrules such that endfaces of the multi-fiber fiber optic ferrules are oriented to face and be positioned against a polishing surface of a polishing component, the polishing device including a mounting platform;

the polishing component positioned on the mounting platform of the polishing device;

an application device including a spray nozzle for dispensing of fluid in a fine mist onto the polishing surface of the polishing component to completely coat the polishing surface with the fluid;

wherein an orientation of the application device is adjustable relative to the polishing device such that (i) the spray nozzle of the application device is positionable about 8 inches to about 12 inches away from the polishing surface of the polishing component, and (ii) the spray nozzle of the application device is positionable at a downward angle of about 20° to about 30° relative to horizontal and the polishing surface; and wherein the orientation of the application device relative to the polishing surface is maintained stationary during dispensing of the fine mist onto the polishing surface.

18. The system of claim 17, wherein the application device is configured to apply the fine mist of the fluid from the spray nozzle toward the polishing surface in a conical configuration, the conical configuration of the fine mist including an angle of about 15° to about 20° between topmost and bottommost spray lines extending from the spray nozzle.

19. The system of claim 17, wherein the application device is configured to dispense about 2 mL to about 6 mL of the fine mist of the fluid onto the polishing surface with the spray nozzle to completely coat the polishing surface with the fluid.

20. The system of claim 17, wherein polishing the endfaces of the multi-fiber fiber optic ferrules with the polishing surface completely coated with the fluid forms a fine slurry with particulate matter from polishing of the endfaces of the multi-fiber fiber optic ferrules and the fluid on the polishing surface, the fine slurry providing a substantially uniform suspension resulting in coplanarity along the polishing surface.

* * * * *